US006504148B1

(12) United States Patent
Hager

(10) Patent No.: US 6,504,148 B1
(45) Date of Patent: Jan. 7, 2003

(54) QUADRUPOLE MASS SPECTROMETER WITH ION TRAPS TO ENHANCE SENSITIVITY

(75) Inventor: James W. Hager, Mississauga (CA)

(73) Assignee: MDS Inc., Concord (CA)

( * ) Notice: Subject to any disclaimer, the term of this patent is extended or adjusted under 35 U.S.C. 154(b) by 0 days.

(21) Appl. No.: 09/320,668

(22) Filed: May 27, 1999

(51) Int. Cl.[7] ..... H01J 4/42

(52) U.S. Cl. ..... 250/282; 250/281; 250/287; 250/288; 250/292; 250/299; 250/423 R

(58) Field of Search ..... 250/282, 281, 250/287, 288, 423 R, 299, 292

(56) References Cited

U.S. PATENT DOCUMENTS

| | | | | |
|---|---|---|---|---|
| 5,179,278 A | | 1/1993 | Douglas | 250/290 |
| 5,576,540 A | | 11/1996 | Jolliffe | 250/292 |
| 6,093,929 A | * | 7/2000 | Javahery et al. | 250/282 |
| 6,111,250 A | * | 8/2000 | Thomson et al. | 250/282 |
| 6,177,668 B1 | * | 1/2001 | Hager | 250/282 |

FOREIGN PATENT DOCUMENTS

| | | | |
|---|---|---|---|
| WO | WO 97/47025 | 6/1997 | H01J/49/42 |
| WO | WO 98/06481 | 8/1997 | H01J/49/00 |

* cited by examiner

*Primary Examiner*—John R. Lee
*Assistant Examiner*—Nikita Wells
(74) *Attorney, Agent, or Firm*—Bereskin & Parr

(57) ABSTRACT

A mass spectrometer method and apparatus has a mass analyzer and a collision cell. The collision cell is configured to trap ions. Precursor ions are selected in the first mass analyzer and then subject to collision-induced dissociation in the collision cell. The fragment ions are then scanned out axially by application of suitable excitation to the ions. The fragment ions can then be detected by a time of flight (TOF) mass spectrometer. For a TOF spectrometer, trapping fragment ions in the collision cell and scanning them out can give enhanced sensitivity.

20 Claims, 8 Drawing Sheets

QUADRUPOLE MASS SPECTROMETER WITH ION TRAPS TO ENHANCE SENSITIVITY

FIELD OF THE INVENTION

This invention relates to a method of and apparatus for enhancing the performance of MS/MS mass spectrometers that involve two sequential mass analyzing steps. This invention more particularly relates to such a technique effective in a mass spectrometer with axial ejection from a linear ion trap with axial ejection.

BACKGROUND OF THE INVENTION

It is common in mass spectrometry to use at least two mass spectrometers in series separated by a gas filled collision cell. In triple quadrupole instruments the first mass spectrometer, often designated as MS1, is a resolving quadrupole followed by a collision cell operated in total ion mode and finally a second mass resolving quadrupole, often designated as MS2. The collision cell, in known manner includes another quadrupole rod set. These quadrupole rod sets are commonly referred to as Q1, Q2 and Q3 respectively and the ion path is often referred to as QqQ, where Q denotes a quadrupole rod set that can be operated in a mass resolving mode, and q a rod set used for collision induced dissociation and fragmentation. Such a configuration will often include a further upstream rod set, commonly denoted Q0, which is operated just as an ion guide. It serves to focus the ions and further eliminate gas from the ion stream, usually generated by an atmospheric source.

MS/MS experiments, as they are usually known, can be carried out in such instruments and involve choosing specific precursor ions with Q1, fragmenting the precursor ions in a pressurized Q2 via collisions with neutral gas molecules to produce fragment or product ions, and mass resolving the product ions with Q3. This technique has proven to be very valuable for identifying compounds in complex mixtures and in determining structures of unknown substances. Several possible scanning modes of MS/MS operation are well known and these are:

(1) setting MS1 (Q1) at a particular precursor ion m/z value to transmit a small range of mass resolved ions into the collision cell (Q2), while (Q3) is scanned to provide a product ion spectrum;

(2) setting MS2 (Q3) at a particular product ion m/z value and then scanning MS1 (Q1) to provide a precursor ion spectrum; and (3) scanning both MS1 (Q1) and MS2 (Q3) simultaneously with a fixed m/z difference between them, to provide a neutral loss spectrum.

Thus the m/z value of a precursor ion, a product ion, or an ion generating a given neutral fragment ion can be determined using MS/MS techniques.

MS/MS techniques generally provide better detection limits than a single stage of mass analysis due to the reduction of chemical noise which is the signal due to generation of ions from other components within the sample, the solute, or the environment surrounding the ion source or within the mass spectrometer itself. MS/MS reduces this nonspecific ion signal and results in better signal-to-noise even though there are two stages of mass resolution which reduce the total number of ions at the detector.

MS/MS instruments based on scanning mass spectrometers, such as quadrupoles, reject the majority of ions formed at any given time within the scan cycle; the essence of scanning is to select a narrow m/z range for further analysis and reject all other ions. Thus, these instruments have inherently poor duty cycles.

Triple quadrupole mass spectrometers are often referred to as "tandem in space" devices since the precursor ion isolation, fragmentation, and fragment ion mass resolution are effected with different ion optical elements located at physically different locations in the ion path. Ion trap mass spectrometers have potentially much greater duty cycles than such tandem in space quadrupole mass spectrometers since all of the ions within the mass spectrometer can be scanned out and detected. The origin of this duty cycle enhancement arises from the fact that ion trap mass spectrometers are typically filled with a short pulse (typically 5–25 ms) of ions from which a complete mass spectrum is generated. On the other hand, in the time required to fill and scan an ion trap, a conventional beam type or tandem is space quadrupole mass spectrometer can only acquire mass spectral information over a very small mass range.

Hybrid MS/MS instruments such as QqTOF instruments, in which the final stage of mass analysis (MS2) is accomplished via a non-scanning time of flight (TOF) mass spectrometer have a duty cycle advantage over QqQ instruments in that the TOF section is not a scanning mass spectrometer, and all of the ions in the product ion mode are collected within a few hundred microseconds. These instruments are typically 10–100 times more sensitive than conventional QqQ instruments in the product ion scan mode of operation.

However in the precursor ion or neutral loss scan modes, in which Q1 is scanned and the ion signal of a particular product ion is measured, the problem of the low duty cycle of a scanning mass spectrometer reappears. In other words, while the TOF section can indeed measure ions over a wide range, in these experiments, one is only interested in an ion of particular m/z value. Additionally, there is an inherent incompatibility between quadrupole stages, which operate in a continuous flow mode, and a TOF stage with intermittent or pulsed operation. For the QqTOF instruments, the overall ion path transmission is considerably less than that of a QqQ instrument (typically ~1% as efficient as a QqQ due largely to this incompatibility). This is exacerbated by the low duty cycle that reappears in the precursor ion and neutral loss scan modes. Consequently many TOF scans must be acquired at each parent ion mass to generate a precursor ion scan with reasonable signal-to-noise and this also applies for the neutral loss scan. This can increase the time acquired for each such experiment to tens of minutes.

In applicant's U.S. Pat. No. 6,177,668 and also in published international application WO 97/47025, there is disclosed a multipole mass spectrometer provided with an ion trap and an axial ejection technique from the ion trap. The contents of these applications are hereby incorporated by reference.

The technique relies upon emitting ions into the entrance of a rod set, for example a quadrupole rod set, and trapping the ions at the far end by producing a barrier field at an exit member. An RF field is applied to the rods, at least adjacent to the barrier member. The barrier member is supplied with a barrier field to trap ions, and the barrier and RF fields interact in an extraction region adjacent to the exit end of the rod set and the barrier member, to produce a fringing field. Ions in the extraction region are energized, to eject, mass selectively, at least some ions of a selected mass-to-charge ratio axially from the rod set and past the barrier field. The ejected ions can then be detected. Various techniques are taught for ejecting the ions axially, namely scanning the frequency of an auxiliary AC field applied to the end lens or barrier, scanning the amplitude of an RF voltage applied to the rod set while applying a fixed frequency auxiliary voltage to the end barrier and applying an auxiliary AC voltage to the rod set (again scanned in frequency) in addition to, or instead of, that on the lens and the RF on the rods.

It has now been realized that this technique can be used to enhance the performance of a triple quadrupole or QqTOF instrument, or indeed in general any tandem in space MS/MS instrument including a collision cell between two mass analyzers.

SUMMARY OF THE INVENTION

In accordance with a first aspect of the present invention, there is provided a method of mass analyzing a stream of ions, the method comprising the steps of:

(1) passing the ions through a first mass analyzer to select a precursor ion;

(2) subsequently passing the precursor ions into a collision cell containing a gas, to cause dissociation of the precursor ions and the formation of fragment ions, for subsequent analysis, wherein the method includes trapping the fragment ions in the collision cell by means of a potential barrier, and scanning the fragment ions axially out therefrom by excitation of the ions, whereby the fragment ions can traverse the potential barrier.

Preferably, the method includes providing a barrier at an exit from the collision cell and providing a quadrupole rod set in the collision cell, the method comprising scanning the ions out of the collision cell by applying at least one of the following group of signals: An AC signal to the barrier; an AC signal to the rod set; and an RF signal to the rod set, wherein the method includes scanning ions out of the quadrupole rod set by at least one of:

(a) scanning the amplitude of the RF signal;

(b) scanning the frequency of the AC signal; and (c) scanning the amplitude of the RF signal, without any applied signal, to effect ejection of ions approaching a q-value of approximately 0.9.

Ions exiting from the collision cell can be detected with a detector or with a mass spectrometer, more preferably a time of flight mass spectrometer. The time of flight mass spectrometer is advantageously arranged orthogonally to the collision cell.

The ions can be pre-trapped in a first quadrupole rod set upstream of the first mass analyzer, so that the ions can then be admitted as pulses into the first mass analyzer. Then, a further quadrupole rod set can be provided as the first mass analyzer, for selecting the precursor ions.

The method of the present invention can include effecting a precursor scan by scanning the fragment ions out of the collision cell and detecting a selected ion or ions and stepping the first mass analyzer through a range of mass-to-charge ratios to select a range of precursor ions for recording against the selected ion or ions detected.

Alternatively, the method can be used to effect a neutral loss scan, the method comprising selecting a precursor ion in the first mass analyzer having a first mass-to-charge ratio and detecting fragment ions having a second mass-to-charge ratio leaving the collision cell, wherein the method comprises maintaining a fixed neutral mass difference between the first and second mass-to-charge ratios and stepping the first and second mass-to-charge ratios through desired ranges.

Another aspect of the present invention provides an apparatus, for mass analyzing a stream of ions, the apparatus comprising: a mass analyzer; a collision cell; a means of trapping ions in the collision cell; a means for exciting ions to enable ions to be scanned out of the collision cell axially; and a time of flight mass spectrometer for receiving ions from the collision cell.

Preferably, the collision cell includes a quadrupole rod set and a barrier providing an interquad aperture between the quadrupole rod set and the time of flight mass spectrometer, and voltage supply means connected to the quadrupole rod set and the barrier, for supplying at least one of: an AC signal to the barrier; an AC signal to the rod set; and an RF signal to the rod set, and wherein the apparatus includes a chamber in which the quadrupole rod set is mounted and means for supplying a collision gas to the chamber.

More preferably, the first mass analyzer comprises a quadrupole rod set mounted axially upstream from the collision cell, and the apparatus further including voltage supply means for supplying RF and resolving DC voltages to the quadrupole rod set of the first mass analyzer.

The apparatus can include a further quadrupole rod set, axially aligned with the quadrupole rod set of the collision cell and the quadrupole rod set of the first mass analyzer and provided upstream of the first mass analyzer, and wherein the apparatus also includes a plate providing a further interquad aperture between the further quadrupole rod set and the mass analyzer, whereby ions can be pre-trapped in the further quadrupole rod set.

Preferably, the time of flight mass spectrometer comprises an orthogonal time of flight mass spectrometer. Moreover, the time of flight mass spectrometer can include a straight through detector, whereby to detect ions of a particular mass-to-charge scanned out of the collision cell, ions can be detected continuously at the detector without pulsed operation of the time of flight mass spectrometer.

BRIEF DESCRIPTION OF THE DRAWINGS

For a better understanding of the present invention and to show more clearly how it may be carried into effect, reference will now be made, by way of example, to the accompanying drawings which show preferred embodiments of the present invention and in which.

DETAILED DESCRIPTION OF THE INVENTION

Figure 1:
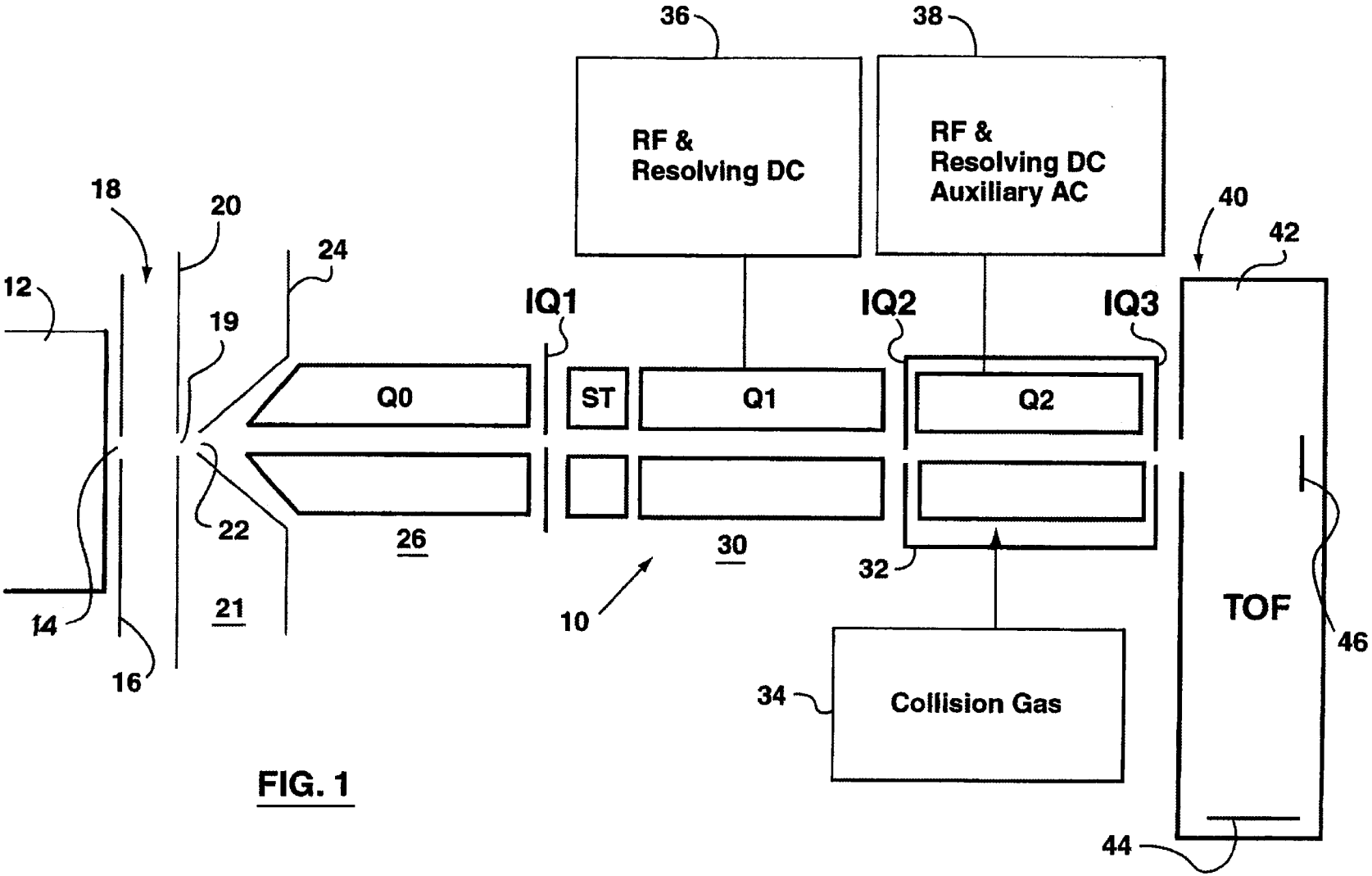
FIG. 1 shows a schematic view of a first embodiment of an apparatus in accordance with the present invention.

Referring first to FIG. 1, an apparatus in accordance with the present invention is indicated generally by the reference 10. In known manner, the apparatus 10 includes an ion source 12, which may be an electrospray, an ion spray, a corona discharge device or any other known ion source. Ions from source 12 are directed through an aperture 14 in an aperture plate 16. On the other side of the plate 16, there is a current gas chamber 18 which is supplied with curtain gas from a source (not shown). The curtain gas can be argon, nitrogen or other inert gas, such as described in U.S. Pat. No. 4,861,988, Cornell Research Foundation Inc., which also discloses a suitable ion spray device.

The ions then pass through an orifice 19 in an orifice plate 20 into a differentially pumped vacuum chamber 21. The ions then pass through an aperture 22 in a skimmer plate 24 into a first chamber 26.

Typically, pressure in the differentially pumped chamber 21 is of the order of 2 torr and the first chamber 26 is evacuated to a pressure of about 7 mTorr. Standard auxiliary equipment, such as pumps, is not shown in any of the drawings, for simplicity.

In the chamber 26, there is a standard RF-only multipole ion guide Q0. Its function is to cool and focus the ions, and it is assisted by the relatively high gas pressure present in this chamber 26. This chamber 26 also serves to provide an interface between the atmospheric pressure ion source and the lower pressure vacuum chambers, thereby serving to remove more of the gas from the ion stream, before further processing.

An interquad aperture IQ1 separates the chamber 26 from the second main vacuum chamber 30. In the main chamber 30, there are RF-only rods labelled ST (short for "stubbies", to indicate rods of short axial extent) which serve as a Brubaker lens. A quadrupole rod set Q1 is located in the vacuum chamber 30, and this is evacuated to less than $5\times10^{-5}$ torr, preferably approximately $1\times10^{-5}$ torr. A second quadrupole rod set Q2 is located in a collision cell 32, supplied with collision gas at 34, such as nitrogen. The cell 32 is within the chamber 30 and includes interquad apertures IQ2, IQ3 at either end. As the collision cell 32 is used for trapping, as detailed below, it is maintained at a pressure of around $5\times10^{-4}$ torr. The chamber 30, at a pressure of around $2\times10^{-5}$ torr, opens into the main vacuum chamber 42 of a TOF device 40 operated at about $10^{-7}$ torr. This includes the conventional TOF detector 44 and at one end an auxiliary detector 46.

Power supplies 36, for RF and resolving DC, and 38, for RF, resolving DC and auxiliary AC are provided, connected to the quadrupoles Q1, Q2 respectively. In the first embodiment of the invention Q1 is a standard resolving RF/DC quadrupole. The RF and DC voltages are chosen to transmit only the ions of interest into Q2. Q2 is a linear rod type ion trap with axial ejection as disclosed in the co-pending application Ser. No. 09/087,909. Q2 is supplied with collision gas from source 34 to dissociate precursor ions or fragment them to produce fragment or product ions.

The product ions and residual precursor ions are trapped in Q2 by a suitably repulsive DC voltage applied to IQ3. RF, a small amount of resolving DC (if desired), and AC voltages from power supply 38 are applied to the Q2 rods. The fringing fields at the exit of the Q2 linear ion trap couple the radial and axial degrees of freedom so that they are no longer orthogonal. Thus, scanning the RF voltage, i.e. increasing the RF voltage in amplitude, applied to the Q2 rods results in ions being ejected from the Q2 linear trap when they come into resonance with the auxiliary AC voltage also applied to the Q2 rods. The AC voltage may be chosen to be phase locked and synchronized so that of the RF voltage, although this is not necessary.

There are several techniques taught in the copending application Ser. No. 09/087,909 for mass selectively ejecting ions out of a linear ion trap in the axial direction. One may scan the RF voltage in the presence of a fixed frequency auxiliary AC voltage applied to either the rods or to the exit member of the linear ion trap. When applied to the rods the auxiliary AC voltage may be applied in either dipolar or quadrupolar fashion. As the RF applied to the rods of the linear ion trap is scanned trapped ions come into resonance with the auxiliary AC field in known manner and are ejected from the ion trap. Alternatively, ions may be axially ejected from the linear ion trap by scanning the frequency of the auxiliary AC field at a fixed RF voltage. Finally, ions may be scanned out of the linear ion trap in the absence of an auxiliary AC field by making use of the high q-value cutoff near 0.9. Note that, in this later case using scanning at the q-value cutoff at 0.9 and also when a fixed AC signal is applied to the rods and the RF signal scanned in amplitude, ions are ejected axially and radially. It has been found that approximately 18% of ions are ejected axially, which gives an acceptable efficiency.

A precursor ion scan function is carried out in the following fashion. A pulse of ions is extracted from Q0 by applying a suitable DC voltage pulse to lens IQ1 and are allowed to pass through Q1. Q1 is a standard RF/DC quadrupole mass analyzer as mentioned above; it is not operated as an ion trap, but it does mass select a precursor ion of interest. The precursor ions that have been mass selected by Q1 are accelerated by a predetermined voltage difference into the Q2 linear ion trap which is pressurized with collision gas. The energy of the precursor ions causes them to collide with the gas and dissociate into fragment ions. The fragment ions and residual precursor ions are trapped in Q2 by a suitably repulsive DC voltage applied to lens IQ3.

Next, as detailed in U.S. Pat. No. 6,177,688, the fragment ions of interest are then mass resolved by the Q2 linear ion trap preferably by scanning the RF voltage applied to the Q2 rods in the presence of a fixed frequency AC voltage also applied to the Q2 rods. As the RF voltage is scanned trapped ions within Q2 come into resonance with the auxiliary AC voltage and are resonantly excited. The resonantly excited ions in the exit fringing field region gain sufficient energy to overcome the DC repulsive voltage on IQ3 and are ejected axially toward the TOF.

Alternatively, ions may be mass selectively ejected from the linear ion trap in the axial direction using several other techniques. The frequency of the auxiliary AC field applied either to rods comprising the linear ion trap or to the barrier of IQ3 can be scanned in the presence of fixed RF voltage. Ions can also be mass selectively ejected toward the TOF by scanning the RF voltage on the rods of the linear ion trap without auxiliary AC. In this case ions are ejected at a q-value near 0.9.

Next, the Q1 mass is incremented by a predetermined amount and then the process is repeated. The scan speed of this approach can be estimated from the fact that the filling and scanning out of the ion(s) of interest from the Q2 ion trap requires a minimum of about 10–20 ms. Thus for a scan range of 1000 amu and a Q1 scanning step size of 1 amu the scan will require 10 to 20 seconds. It is sometimes desirable to include an additional step of emptying any remaining ions within the Q2 linear trap by suitably reducing the RF voltage applied to the Q2 rods. This can be done very rapidly (less than 2 ms) and will only slightly affect the time of the experiment.

There are several advantages to this approach to precursor ion scanning relative to the conventional technique. Since the second stage of mass resolution is accomplished with the linear ion trap, the ions can be measured via the "straight through" detector 46 which bypasses the TOF section entirely. This dramatically increases the overall ion path transmission efficiency since ions can be focused onto such detectors very efficiently, and it avoids the inevitable losses from pulsed operation of the TOF 40. Alternatively the TOF stage 40 can be operated in the mass independent "total ion" mode in which the TOF ion extraction voltage is not pulsed but rather simply used to redirect ions to detector 44. Either approach will result in considerably greater sensitivity compared with having a conventionally operated TOF 40 as the final stage of mass analysis and ultimately greater mass scanning rates. If desired, the ions can still be routed through the TOF section while it is operating in resolving mode which allows the efficient mass resolution powers of the TOF to be used at the expense of signal intensity. It is desirable in this mode of operation to synchronize the TOF ion extraction pulsing electronics with the scanning of the Q1 linear ion trap. For example the TOF extraction electronics should be pulsed at every Q2 scan increment to achieve maximum sensitivity.

Enhanced sample utilization efficiency also results from operation of the collision cell as a linear ion trap since the mass spectral response of the predetermined product ions can be generated for each short pulse of ions emerging from Q0. Consider the example of a 25 ms pulse of ions emerging from Q0, being mass selected by Q1 and fragmented by accelerating these ions by the voltage drop between Q1 and the linear ion trap Q2. The product ions of interest can be scanned out of the linear ion trap in as little time as 20 ms. This yields an effective duty cycle of 25 ms/(25 ms+20 ms)×100%=56%. This is much higher than that associated with standard QqTOF instruments which are on the order of less than 1%.

This duty cycle enhancement can be increased even more by making use of the technique taught in U.S. Pat. No. 5,179,278 of accumulating ions in Q0 while the ion trap is scanning. As demonstrated in U.S. Pat. No. 5,179,278, duty cycles approaching 100% can be achieved in this fashion.

Neutral loss scans can be accomplished in a similar fashion with similar performance enhancements. A pulse of ions is extracted from Q0 by applying a suitable DC voltage pulse to lens IQ1 and is allowed to pass through Q1 into the Q2 linear ion trap which is pressurized with collision gas to dissociate precursor ions into fragment ions. As before, Q1 is operated in a mass resolving mode. The fragment ions and any residual precursor ions are trapped in Q2 by a suitably repulsive DC voltage applied to lens IQ3. The fragment ions with a pre-selected mass difference relative to the precursor ion are then scanned axially out of Q2 mass selectively toward the orthogonal TOF 40, which is operated in total ion mode. Again, the ions are scanned out of the linear ion trap preferably by applying an auxiliary AC signal to the Q2 rods and scanning the RF voltage. The other alternative techniques described above for mass selective axial ejection from a linear ion trap are also applicable for this enhanced neutral loss method.

Next, the mass selected in Q1 and mass scanned out of the trap Q2 are incremented by the same predetermined amount to maintain a neutral ion scan and the process is repeated.

The TOF section 40 can again be bypassed using the straight through detector 46, to obtain maximum ion signal intensity; or as detailed above the TOF can be in total ion mode with the TOF extraction electronics operated continuously detecting ions at detector 44. Alternatively, the ions can still be routed through the TOF section while it is operating in resolving mode which allows the excellent mass resolution powers of the TOF to be used at the expense of signal intensity. Again synchronization of the ion extraction pulses of the TOF and the Q2 linear ion trap scanning increment will produce the best results. The duty cycle and sample utilization advantages from using the collision cell as a mass selective linear ion trap discussed above for a precursor/parent ion scan are also applicable to the neutral loss scan mode and will further enhance instrument sensitivity and thus enhanced scan speeds.

Although the above embodiment is discussed in terms of a QqTOF instrument, it is equally applicable to other MS/MS instruments that incorporate a collision cell between two resolving mass analyzers. Thus, the intention of the present invention is to operate the collision cell as a mass resolving device allowing the downstream mass spectrometer to be operated in total ion mode leading to enhanced sensitivity and ultimately greater scan speeds. Preferably, before the first mass analyzer there is a multipole ion guide that can be configured as an ion trap, to improve the duty cycle by storing ions and releasing their pulses as taught by U.S. Pat. No. 5,179,278.

Figure 2:
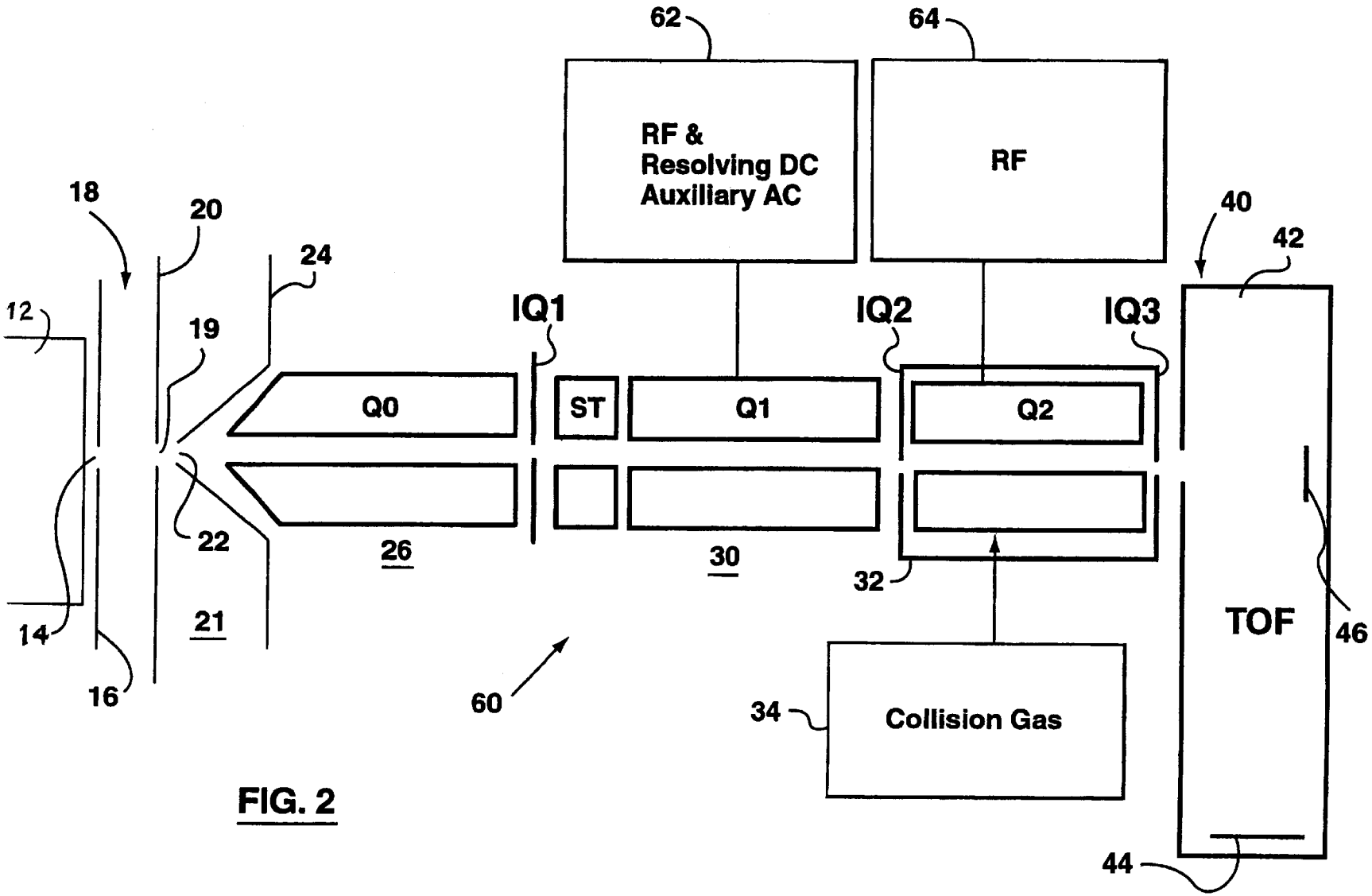
FIG. 2 shows schematically a second embodiment of an apparatus in accordance with the present invention.

Reference is made to the apparatus 60 of FIG. 2, and for simplicity like components are given the same reference as in FIG. 1. Once again Q0 is a standard RF-only multipole ion guide in a chamber evacuated to a pressure of about 7 mTorr. The RF-only rods labelled ST serve as a Brubaker lens. Q1 and Q2 are located in the downstream vacuum chamber 30 again evacuated to about $10^{-5}$ torr. Here, a power supply 62, for RF, resolving DC and auxiliary AC is connected to the rod set Q1 and a power supply 64 just for RF is connected to the rod set Q2.

Here, Q1 is operated as a low pressure rod type linear ion trap with axial ejection as is disclosed in U.S. Pat. No. 6,177,688, and again a pressure of less than $5\times10^{-5}$ torr. The Q1 linear ion trap rods are supplied with RF voltage, low level resolving DC, (if desired) and AC voltage (if desired) from power supply 62. Q2 is operated as a standard RF-only collision cell with RF voltage supplied by power supply 64 and collision gas from supply 34, i.e. without resolving DC and without any auxiliary AC signal. For this purpose, the collision cell is maintained at a pressure of 5 mTorr.

In this second embodiment, a precursor ion scan function is carried out in the following fashion. Ions are pre-trapped in QO by a suitable repulsive voltage on lens IQ1, into Q1 with a concurrently applied repulsive voltage to lens IQ2 thereby trapping the ions in Q1. These trapped ions within Q1 are then mass selectively scanned out of the Q1 trap by screening the RF voltage applied to the Q1 rods. The extracted ions are then accelerated into the pressurized Q2 to dissociate precursor ions into fragment ions. It is desirable to operate the Q2 collision cell with an axial field to maintain good temporal characteristics of the ions through the neutral gas. The residual precursor and fragment ions are then mass resolved with the TOF mass spectrometer 40 and the intensity of the product ion of interest is plotted vs. Q1 mass scale to provide a precursor ion scan. Since the TOF 40 provides the final stage of mass analysis and because a complete product ion mass spectrum is acquired at each mass position of Q1 a complete set of precursor ion, product ion, and neutral loss spectra are obtained.

It is desirable in this mode of operation to synchronize the TOF ion extraction pulsing electronics with the scanning of the Q1 linear ion trap. For example, the TOF extraction electronics should be pulsed at every Q1 scan increment to achieve maximum sensitivity.

This approach also has similar sample utilization efficiency and sensitivity advantages as the first embodiment. As is the case in the first embodiment further efficiency enhancements can be achieved by accumulating ions in Q0 while the Q1 ion trap is scanning as disclosed in U.S. Pat. No. 5,179,278.

This mode of operation and performance enhancements are generally applicable to Qq(MS) instruments such as conventional QqQ triple quadrupole mass spectrometers, although the complete set of precursor ion, product ion, and neutral loss spectra are only obtained if the second stage of mass spectrometry is carried out by a non-scanning mass spectrometer such as a time of flight mass spectrometer.

Figure 3:
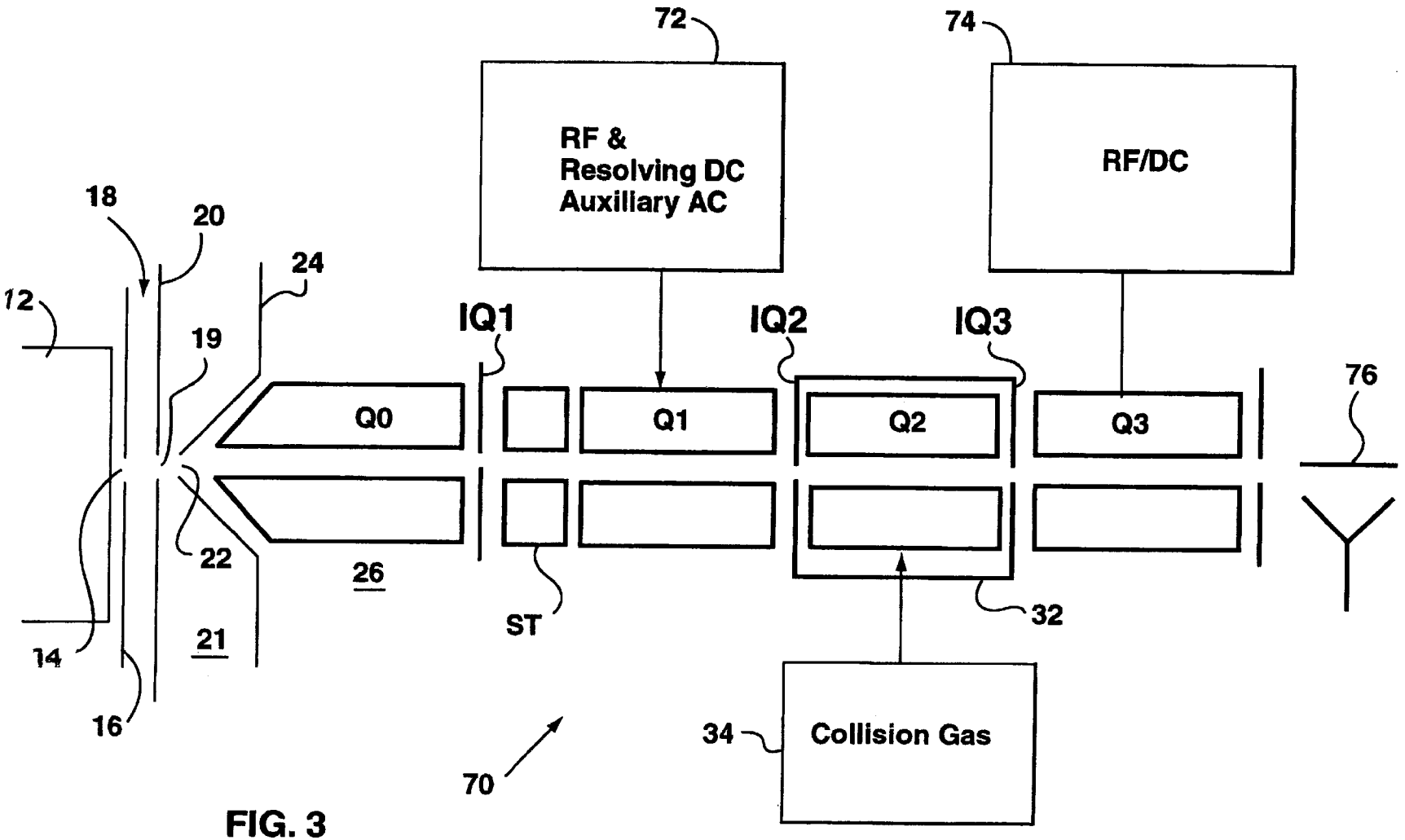
FIG. 3 shows schematically a third embodiment of an apparatus in accordance with the present invention.

As an example of the general applicability of this scan mode, reference is made to a third embodiment 70 of the present invention, a modified triple quadrupole mass spectrometer, which is illustrated in FIG. 3. Again, for simplicity and brevity like components are given the same reference numeral and their description is not repeated.

Ions are directed from ion source 12 through the aperture 14 into the curtain gas chamber 18 into a differentially pumped region 21 maintained at a pressure of about 2 torr. The ions then pass through a skimmer orifice 22 in the skimmer plate 24 and into the first main vacuum chamber 26 evacuated to a pressure of about 7 mTorr and containing the rod set QO. Following this is the second vacuum chamber 30. The main vacuum chamber 30 houses four rod arrays: ST, Q1, Q2 and Q3, and a conventional ion detector, here indicated at 76. Interquad apertures IQ1, IQ2, IQ3 are provided, as before and Q2 is located in collision cell 32. Here, power supplies 72 for RF, resolving DC and auxiliary AC, and 74, for RF and DC are connected to quadrupole rod sets Q1, Q3. Again Q1 and also Q3, are at less than $5\times10^{-5}$ torr and the collision cell 32 is again at 5 mTorr. The pressure in the Q0 region is typically $1\times10^{-4}$ to $1\times10^{-2}$ torr.

The ions passing through skimmer aperture 22 are transmitted through lens IQ1 using the QO rod array, operated in RF-only mode (as for other figures, the power supply is not shown). Ions passing through IQ1 and rods ST enter the Q1 rod array which is operated as linear ion trap as discussed in the U.S. Pat. No. 6,177,668, and provided with RF, resolving DC and auxiliary AC voltages. Downstream of Q1 is the RF-only Q2 pressurized collision cell. Following this, in this third embodiment 70, there is the third quadrupole Q3 which is a standard RF/DC resolving quadrupole mass spectrometer, having an output connected to a detector 76.

The precursor ion scan function for the apparatus in FIG. 3 is carried out in the following fashion. Ions are pre-trapped in QO by a suitable repulsive voltage on lens IQ1, and then at appropriate times released as pulses into Q1 with a concurrently applied repulsive voltage to lens 1Q2 thereby trapping the ions. These trapped ions within Q1 are then mass selectively scanned out of the Q1 trap by scanning the RF voltage applied to the Q1 rods. The extracted ions are then accelerated into the pressurized Q2 to dissociate precursor ions into fragment ions. The residual precursor and fragment ions are then mass resolved with the Q3 quadrupole mass spectrometer and the intensity of the product ion of interest is plotted vs. Q1 mass scale to provide a precursor ion scan. The RF and DC voltages applied to the Q3 rod array are chosen to transmit a m/z window corresponding to a predetermined product ion.

This scan method has the sample utilization efficiency and sensitivity advantages that ions from the source are accumulated in QO while the linear ion trap (here Q1) is scanning thereby wasting few of the ions generated by ion source 14.

Figure 4:
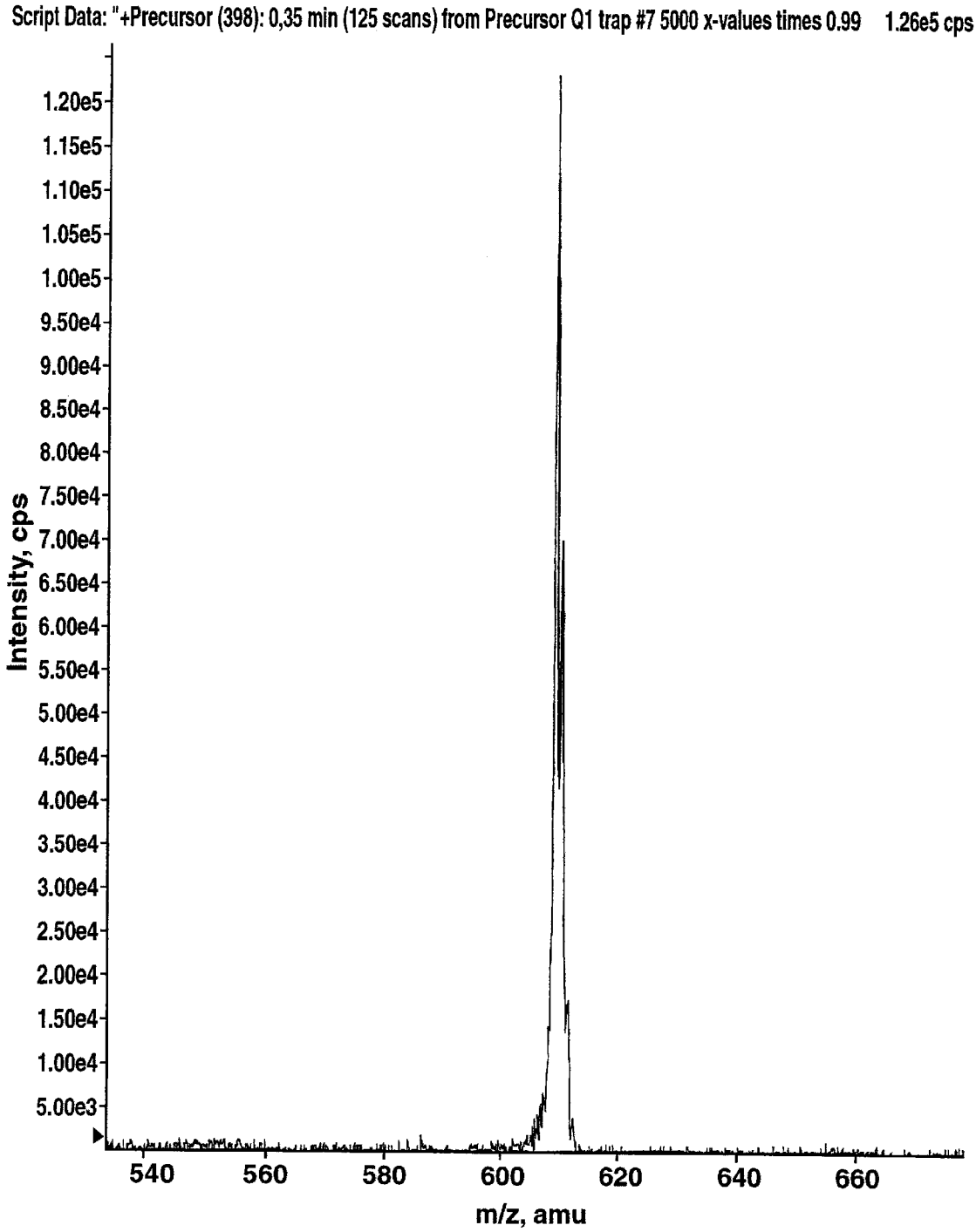
FIG. 4 shows a precursor ion MS/MS spectrum obtained from the apparatus of FIG. 3 operated in accordance with the present invention.

FIG. 4 is a precursor ion MS/MS spectrum obtained with the apparatus in FIG. 3 and the scan method discussed above. Here, a solution of 100 pg/$\mu$L of reserpine (m/z 609) was ionized with an electrospray source. The Q1 linear ion trap was operated with a very small amount of resolving DC (<3V) and no AC voltage. Thus, ion ejection occurred near q=0.9. Q3 was tuned to transmit a 3 dalton wide window at the known product ion located at m/z 397.

The precursor mass spectrum in FIG. 4 was obtained from a 100 ms pulse of ions allowed to pass into the Q1 linear ion trap. The ions trapped in Q1 were mass selectively ejected by scanning the RF voltage applied to the Q1 rods at 5000 amu/s and accelerated by a 30V drop into the pressurized Q2 thus inducing fragmentation into product ions. The product ions were then directed into the RF/DC Q3 tuned to the m/z 397 product. The spectrum in FIG. 4 corresponds to the m/z 397 product ion intensity as a function of Q1 mass.

Figure 5:
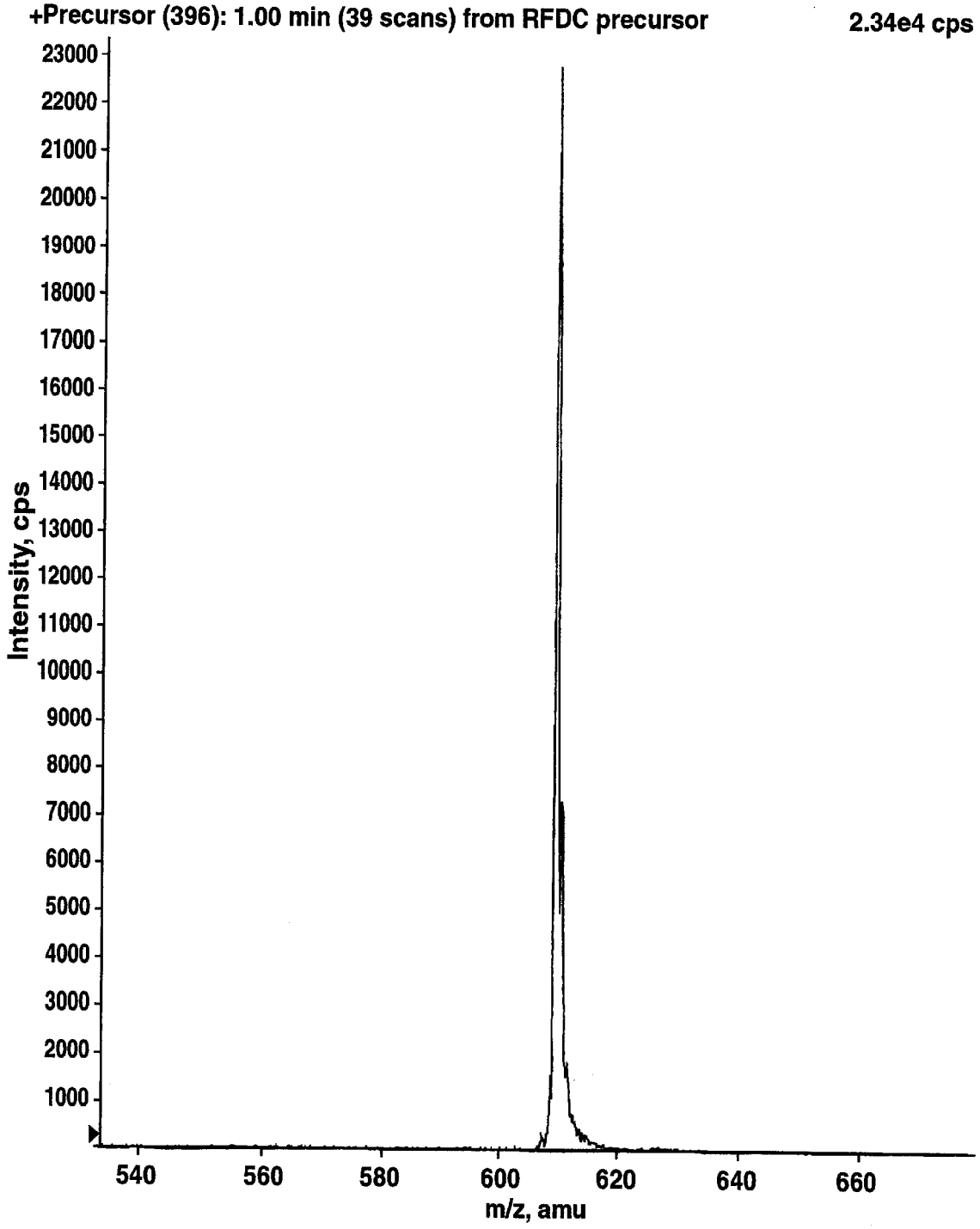
FIG. 5 shows a precursor ion MS/MS spectrum obtained from the apparatus of FIG. 3 operated in a conventional manner.

The sensitivity of the spectrum shown in FIG. 4 is approximately 5 times greater than that obtainable for the apparatus in FIG. 3 operated in conventional RF/DC mode due to the duty cycle enhancement for the Q1 linear ion trap. Such a conventional mode RF/DC precursor mass spectrum is shown in FIG. 5 for comparison purposes. Proportionately greater signal intensities than that in FIG. 4 can be achieved with the apparatus in FIG. 3 by simply filling the Q1 ion trap for longer periods of time.

Figure 6:
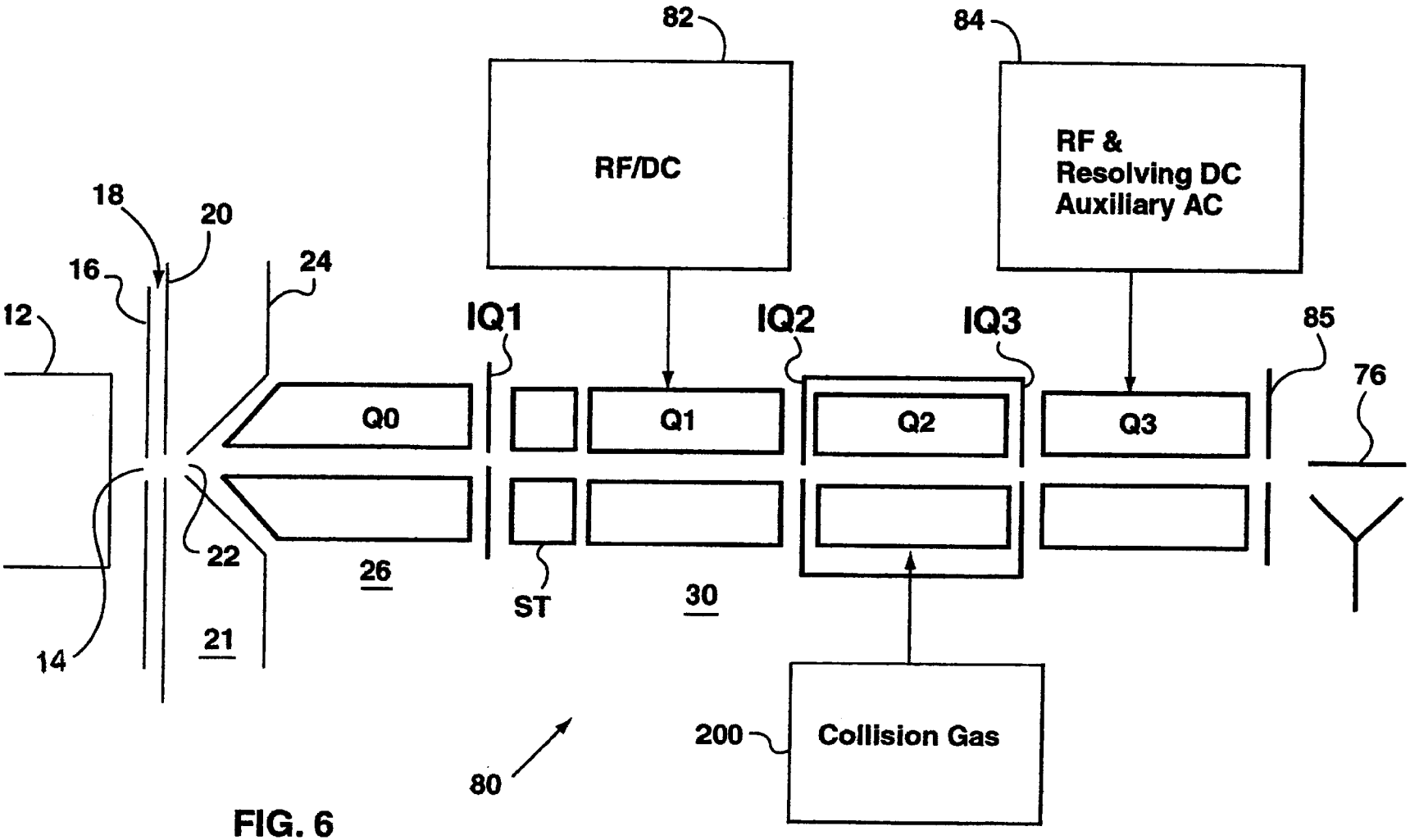
FIG. 6 is a schematic diagram of a triple quadrupole mass spectrometer, incorporating the present invention.

Reference will now be made to FIG. 6 which shows a fourth embodiment of the present invention, based on a standard QqQ triple quadrupole mass spectrometer. For simplicity like components are given the same reference number as in FIG. 3.

Once again Q0 is a standard RF-only multipole ion guide in a chamber evacuated to a pressure of about 7 mTorr. The RF-only rods labelled ST serve as a Brubaker lens. Q1, Q2, and Q3 are located in the downstream vacuum chamber 30. Other pressures correspond to the FIG. 3 embodiment. Here, a power supply 82, for RF and resolving DC is connected to the rod set Q1 and a power supply 84 for RF, resolving DC, and auxiliary AC is connected to the rod set Q3 and capacitively coupled to Q2 (coupling not shown).

Here, Q1 is operated as a standard RF/DC quadrupole mass filter. The RF and DC voltages are chosen to transmit only the ions of interest into Q2. Q2 is a standard pressurized RF-only collision cell with no ion trapping. Q3 is operated as a low pressure rod type ion trap with axial ejection as is disclosed in U.S. Pat. No. 6,177,668. The Q3 linear ion trap rods are supplied with RF voltage, low level DC voltage (if desired), and AC voltage (if desired) from power supply 84.

Product ion information can obtained in the following fashion. A pulse of ions from Q0 is released, by changing the normally repulsive voltage on lens IQ1 and is allowed to pass through Q1. Q1 is a standard RF/DC quadrupole mass spectrometer; it is not operated as an ion trap, but does select the precursor ion of interest. The precursor ions of interest are accelerated by a predetermined voltage difference into Q2. The energy of the precursor ions causes them to collide with the gas within Q2 and dissociates them into fragment ions. The fragment ions are then trapped in Q3 which is operated as a low pressure ion trap by suitably repulsive voltage on lens 85. The pressure in Q3 is typically around $10^{-5}$ torr.

Next, as detailed in earlier application Ser. No. 09/087,909, the fragment ions of interest are then mass resolved by the Q3 linear ion trap preferably by scanning the amplitude of the RF voltage applied to the Q3 rods in the presence of a fixed frequency AC voltage also applied to the Q3 rods. As the RF voltage is scanned trapped ions within Q3 come into resonance with the auxiliary AC voltage and are resonantly excited. The resonantly excited ions in the exit fringing field region gain sufficient energy to overcome the repulsive DC voltage on lens 85, and are ejected toward the ion detector 76.

Alternatively, ions may be mass selectively ejected from the Q3 linear ion trap in the axial direction using several other techniques. The frequency of the AC field applied either to the rods comprising the ion trap or to lens 85 can be scanned in the presence of fixed RF voltage. Ions can also be scanned out toward the ion detector 76 without the auxiliary AC, in other words at the stability boundary near the q-value of 0.9.

Figure 7:
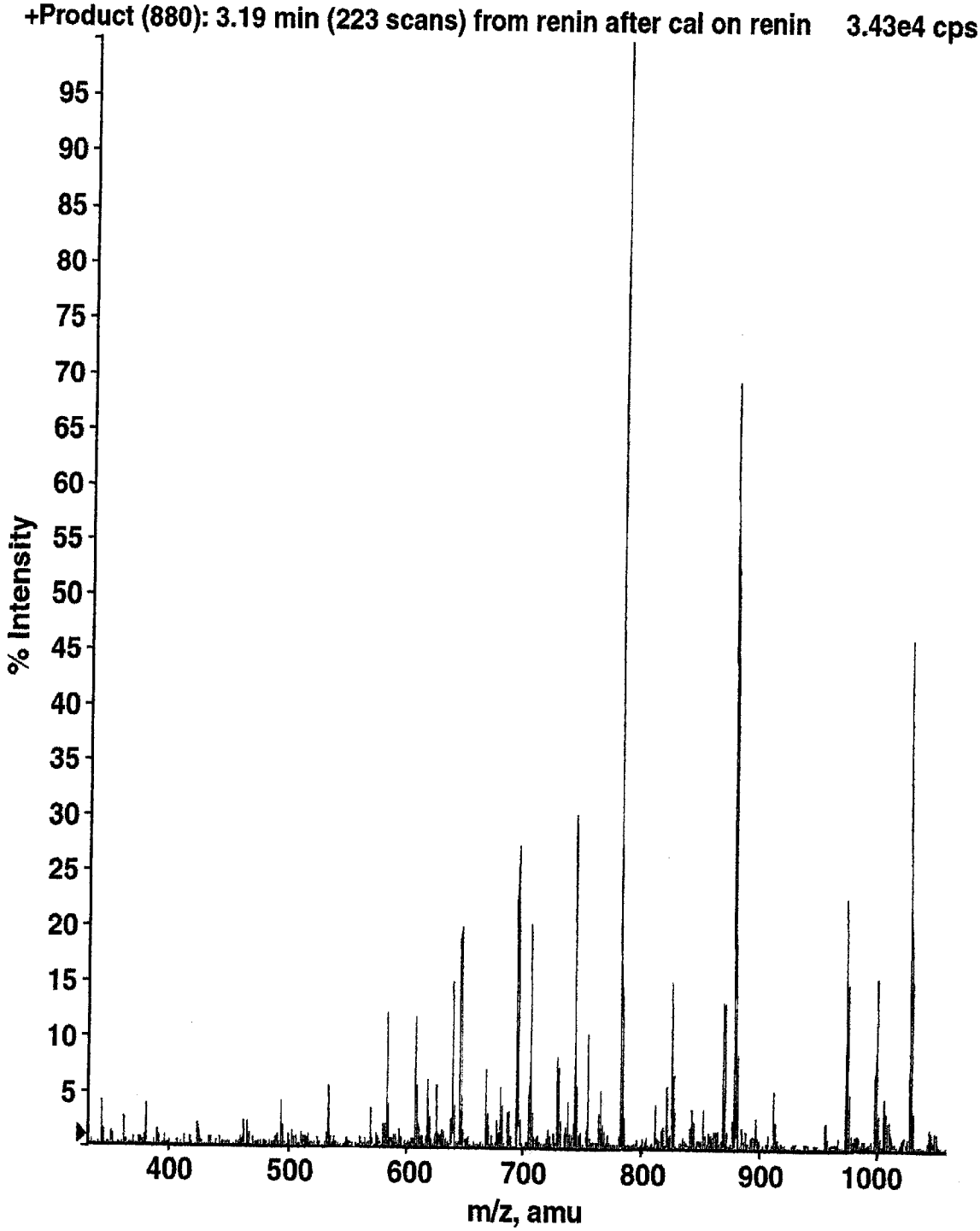
FIGS. 7 and 8 are product ion spectra obtained from the spectrometer of FIG. 6.

FIG. 7 is a product ion MS/MS spectrum obtained with the apparatus in FIG. 6 and the scan method discussed above. Here, a solution of 5 pmol/$\mu$L of renin substrate tetradecapeptide (Angiotensinogen 1–14) with a formula weight of 1757.0 was ionized with an electrospray source. The Q3 linear ion trap was operated with no resolving DC and an AC frequency of 869 kHz at 1.04 volts (peak-to-peak) applied in a quadrupolar fashion. Q1 was tuned to transmit a 2 amu wide window at the known doubly protonated parent ion mass of m/z ~880.

The product ion mass spectrum in FIG. 7 was obtained from a 10 ms pulse of ions, which was allowed to pass through the conventional RF/DC Q1 mass filter and accelerated by a 40 volt drop into Q2 in the pressurized collision cell, and then into Q2 into the Q3 linear ion trap. The fragment and residual parent ions trapped in Q3 were mass selectively ejected by scanning the RF voltage applied to the Q3 rods at 2000 amu/s. The ions that were axially ejected from the Q3 ion trap were detected with the conventional pulse counting ion detector 76.

The sensitivity of the spectrum shown in FIG. 7 is approximately 8 times greater than that obtainable for the apparatus in FIG. 6 operated in conventional RF/DC mode due to the duty cycle enhancement for the Q3 linear ion trap. Proportionately greater signal intensities than those in FIG. 7 can be achieved with the apparatus in FIG. 6 by simply filling the Q3 ion trap for longer periods of time.

Figure 8:
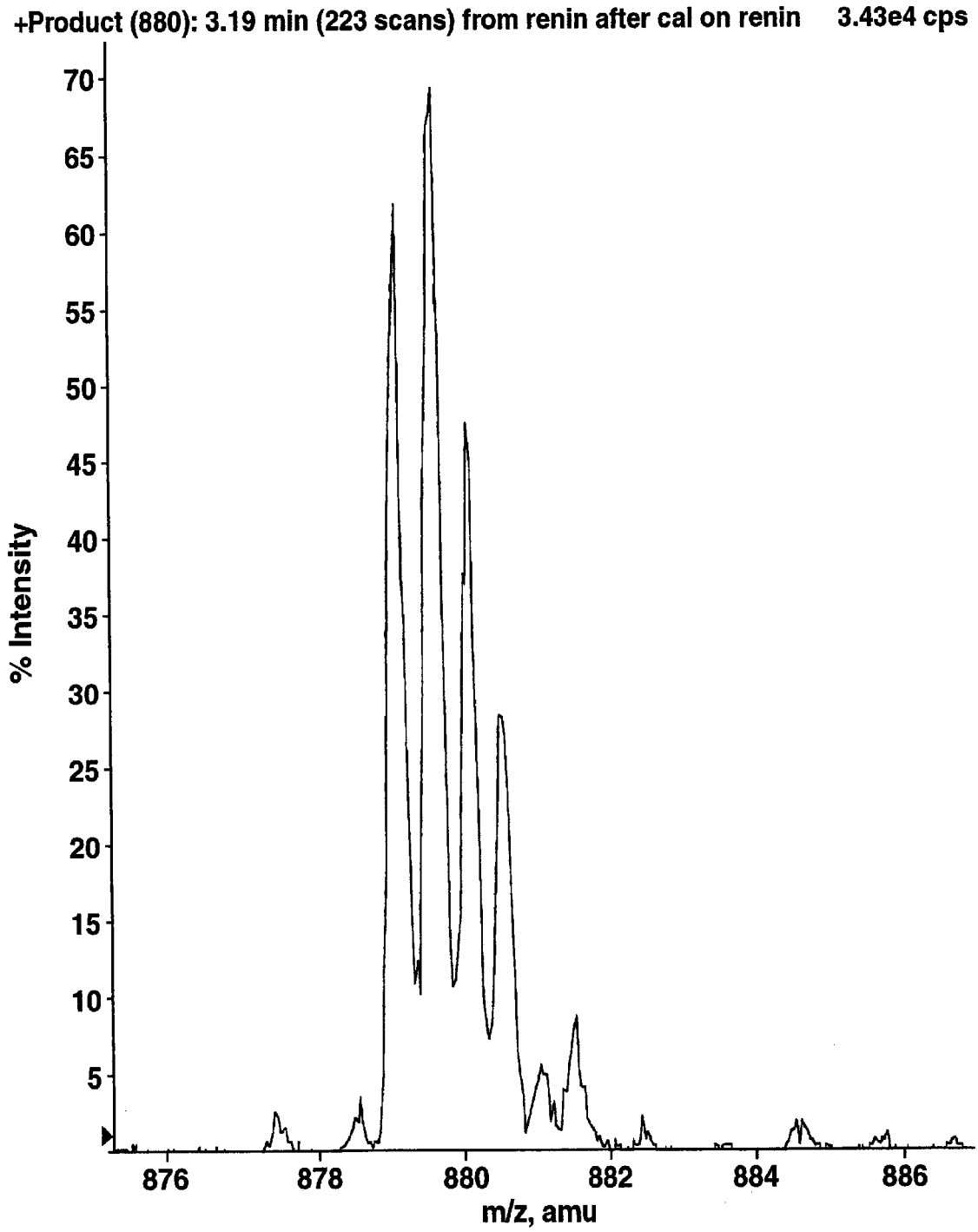

The mass resolution of the spectrum in FIG. 7 is very good as is illustrated by the expanded view of the residual doubly protonated parent ion shown in FIG. 8. The combination of enhanced sensitivity and mass resolving capabilities with the Q3 ion trap and the method described above represent a significant advance over conventional RF/DC operation of a standard triple quadrupole mass spectrometer.

Although the above embodiments have been described for QqQ and QqTOF tandem mass spectrometers, it is understood that these ion trapping methods are generally applicable to any Qq(MS) mass spectrometer. In particular, a variety of different multipole devices could be used, but for trapping and axial ejection it is necessary to use quadrupole rod sets because of their well-defined characteristics.

What is claimed is:

1. A method of mass analyzing a stream of ions, including multiple ion selection steps and fragmentation, to enhance duty cycle efficiency, the method comprising the steps of:

(1) passing the ions through a first mass analyzer to mass select a precursor ion having a first mass-to-charge ratio in a first mass analysis step;

(2) subsequently passing the precursor ions into a collision cell containing a gas, to cause dissociation of the precursor ions and the formation of fragment ions, for subsequent analysis; and (3) mass analyzing the fragment ions and any residual precursor ions in a second mass analysis step; wherein the method includes:

at least one of:

trapping ions in the first mass analyzer by means of an axial D.C. potential barrier, and mass selectively scanning ions out axially therefrom by excitation of the ions whereby the ions can traverse the axial D.C. potential barrier to effect the first mass analysis step; and trapping Ions in the collision cell by means of an axial D.C. potential barrier, and mass_selectively scanning the ions axially out therefrom by excitation of the ions, whereby the ions can traverse the axial D.C. potential barrier, thereby to mass select ions having a second mass-to-charge ratio in a second mass analysis step; and wherein, in the first_and second mass analysis steps, ion mass-to-charge ratios are selected to effect one of a precursor ion scan, a product ion scan and a neutral ion scan, whereby trapping of ions enhances duty cycle efficiency.

2. A method as claimed in claim 1, which includes providing a barrier at an exit from the collision cell and providing a quadrupole rod set in the collision cell, the method comprising scanning the ions out of the collision cell by applying at least one of the following group of signals: An AC signal to the barrier; an AC signal to the rod set; and an RF signal to the rod set, wherein the method includes scanning ions out of the quadrupole rod set by at least one of:

(a) scanning the amplitude of the RF signal;

(b) scanning the frequency of the AC signal; and (c) scanning the amplitude of the RF signal, without any applied AC signal, to effect ejection of ions approaching a q-value of approximately 0.9.

3. A method as claimed in claim 2, which includes detecting ions exiting from the collision cell with a detector.

4. A method as claimed in claim 2, which includes detecting ions exiting from the collision cell with a mass spectrometer.

5. A method as claimed in claim 3, which includes detecting ions exiting from the collision cell with a time of flight mass spectrometer.

6. A method as claimed in claim 5, which comprises detecting ions exiting from the collision cell with a time of flight mass spectrometer arranged orthogonally to the collision cell.

7. A method as claimed in claim 3, 4, or 5, which includes pre-trapping ions before the first mass analyzer and admitting the ions into the first mass analyzer in pulses.

8. A method as claimed in claim 3, 4 or 5, which includes pre-trapping the ions in a first quadrupole rod set upstream of the first mass analyzer, and admitting the ions as pulses into the first mass analyzer for selecting the precursor ions.

9. A method as claimed in claim 3, 4 or 5, which includes trapping ions in the first mass analyzer and scanning desired precursor ions axially out of the first mass analyzer by excitation thereof.

10. A method as claimed in claims 3, 4 or 5, the method including effecting a precursor ion scan by scanning the fragment ions out of the collision cell and detecting a selected ion and stepping the first mass analyzer through a range of mass-to-charge ratios to select a range of precursor ions for recording against the selected ion detected.

11. A method as claimed in claim 10, which includes trapping ions in the first mass analyzer and scanning desired precursor ions axially out of the first mass analyzer by excitation thereof.

12. A method as claimed in claim 3, 4 or 5, which comprises effecting a neutral loss scan, the method comprising selecting a precursor ion in the first mass analyzer having a first mass-to-charge ratio and detecting fragment ions having a second mass-to-charge ratio leaving the collision cell, wherein the method comprises maintaining a fixed neutral mass difference between the first and second mass-to-charge ratios and stepping the first and second mass-to-charge ratios through desired ranges.

13. A method as claimed in claim 12, which includes trapping ions in the first mass analyzer and scanning desired precursor ions axially out of the first mass analyzer by excitation thereof.

14. A method of mass analyzing a stream of ions, including multiple mass selection steps and fragmentation, to enhance duty cycle efficiency, the method comprising, in the following order, the steps of:

(1) passing the ions through a first mass analyzer to mass select a precursor ion having a first mass-to-charge ratio in a first mass analysis step;

(2) passing the precursor ions into a collision cell containing a gas, to cause dissociation of the precursor ions and the formation of fragment ions;

(3) passing the fragment ions and any residual precursor ions into a linear ion trap and retaining ions within the linear ion trap by means of an axial D.C. potential barrier;

(4) scanning ions axially out of the linear ion trap by excitation of the ions, whereby ions can traverse the potential barrier, thereby to mass select ions having a second mass-to-charge ratio in a second mass analysis step; and (5) detecting ions scanned out in step (4), wherein the first and second mass analysis steps, ions are selected to effect one of a precursor ion scan, a product ion scan and a neutral ion scan, whereby trapping of ions enhances duty cycle efficiency.

15. A method as claimed in claim 14, wherein the method includes providing a quadrupole rod set in the linear ion trap and wherein the method further comprises scanning the ions out of the linear ion trap by applying at least one of the following group of signals: An AC signal to the barrier; an AC signal to the rod set of the linear ion trap; and an RF signal to the rod set, wherein the method includes scanning ions out of the quadrupole rod set by at least one of:

(a) scanning the amplitude of the RF signal;

(b) scanning the frequency of the AC signal; and (c) scanning the amplitude of the RF signal, without any applied AC signal, to effect ejection of ions approaching a q-value of approximately 0.9.

16. A method as claimed in claim 15, which includes detecting ions exiting from the linear ion trap with a detector.

17. A method as claimed in claim 15 or 16, which includes pre-trapping ions before the first mass analyzer and admitting the ions into the first mass analyzer in pulses.

18. A method as claimed in claim 15 or 16, which includes pre-trapping the ions in a first quadrupole rod set upstream of the first mass analyzer, and admitting the ions as pulses into the first mass analyzer for selecting the precursor ions.

19. A method as claimed in claims 15 or 16, the method including effecting a product ion scan by selecting a precursor ion in the first mass analyzer and scanning the fragment ions out of the linear ion trap through a range of mass-to-charge ratios to form the product ion scan.

20. A method as claimed in claim 15 or 16, which comprises effecting a neutral loss scan, the method comprising selecting a precursor ion in the first mass analyzer having a first mass-to-charge ratio and detecting fragment ions having a second mass-to-charge ratio leaving the linear ion trap, wherein the method comprises maintaining a fixed neutral mass difference between the first and second mass-to-charge ratios and stepping the first and second mass-to-charge ratios through desired ranges.

* * * * *